US005190095A

United States Patent [19]

Fujimoto et al.

[11] Patent Number: 5,190,095

[45] Date of Patent: Mar. 2, 1993

[54] CONDENSER FOR REFRIGERATOR AND METHOD OF OPERATING THE SAME

[75] Inventors: Masakazu Fujimoto; Toshio Osuna, both of Kanagawa, Japan

[73] Assignee: Ebara Corporation, Tokyo, Japan

[21] Appl. No.: 886,147

[22] Filed: May 21, 1992

[30] Foreign Application Priority Data

May 23, 1991 [JP] Japan ..... 3-146614

[51] Int. Cl.[5] ..... F28G 1/02

[52] U.S. Cl. ..... 165/1; 165/39; 165/95; 165/97

[58] Field of Search ..... 165/39, 95, 97, 1; 15/3.51

[56] References Cited

U.S. PATENT DOCUMENTS

| | | | |
|---|---|---|---|
| 3,307,583 | 3/1967 | Harter | 137/625.43 |
| 4,124,065 | 11/1978 | Leitner et al. | 165/95 |
| 4,269,264 | 5/1981 | Goeldner | 165/95 |
| 4,583,586 | 4/1986 | Fujimoto et al. | 165/95 |
| 4,606,403 | 8/1986 | Fujimoto et al. | 165/95 |
| 4,693,305 | 9/1987 | Fujimoto et al. | 165/95 |

FOREIGN PATENT DOCUMENTS

| | | | |
|---|---|---|---|
| 54-22004 | 2/1979 | Japan | 165/97 |
| 54-137765 | 10/1979 | Japan | 165/97 |
| 59-24196 | 2/1984 | Japan . | |
| 60-33500 | 2/1985 | Japan . | |

OTHER PUBLICATIONS

*Air Conditioner,* pp. 170–171 & 188–189, (With English Abstract) Syuichi Takada, Oct. 31, 1977.

*Primary Examiner*—Allen J. Flanigan

*Attorney, Agent, or Firm*—Oblon, Spivak, McClelland, Maier & Neustadt

[57] ABSTRACT

A condenser for a refrigerator and a method of operating the condenser, in which heat exchanger tubes for cooling the condenser each have brush receivers and cooling water inlet/outlet ports at both ends thereof, one of the brush receivers accommodating a brush for washing the tube, and cooling water supply and discharge pipes are connected to the cooling water inlet/-outlet ports, respectively, through a four-way valve. When the condenser is to be cooled, the opening of the four-way valve is controlled on the basis of the pressure in the condenser or the temperature of the cooling water being discharged to thereby control the flow rate of cooling water supplied to the heat exchanger tubes, whereas when the heat exchanger tubes are to be washed, the four-way valve is switched so as to change the direction of flow in the heat exchanger tubes, thereby allowing the brush to travel through the tubes automatically, and thus automatically washing the inside of the tubes.

7 Claims, 2 Drawing Sheets

CONDENSER FOR REFRIGERATOR AND METHOD OF OPERATING THE SAME

BACKGROUND OF THE INVENTION

1. Field of the Art

The present invention relates to a condenser for a refrigerator and a method of operating the condenser. More particularly, the present invention relates to washing of heat exchanger tubes in such a condenser and also to the control of the flow rate of cooling water in the heat exchanger tubes.

2. Prior Art

In general, the following problems are known with regard to condensers used in refrigerators:

1. When scale from cooling water accumulates on the inner surface of heat exchanger tubes of the condenser, heat transfer is obstructed, and pressure in the condenser rises. In such a case, the following problems arise:

(1) Rise in the operating cost (2) Damage to equipment due to the occurrence of a surging operation or vibration in the case of a centrifugal refrigerator (3) Occurrence of a high pressure trip due to the operation of a pressure upper-limit switch 2. If the temperature of cooling water supplied to the heat exchanger tubes is low, the pressure in the condenser becomes excessively low.

In this case, since the required functions are generally obtained by making use of the pressure difference between the condenser and the evaporator, the following problems arise:

(1) The performance of a refrigerant-cooled oil cooler is lowered, resulting in a rise in the temperature of oil for lubrication.

(2) Because a refrigerant-cooled compressor motor cannot sufficiently be cooled, the coil of the motor overheats.

(3) The performance of an ejector type oil recovery system for recovering lubricating oil that has leaked into the refrigerant system is lowered.

(4) Circulation of refrigerant liquid through the refrigerator deteriorates.

In particular, when well water or river water is used as a cooling water, scale or slime rapidly accumulates on the inner surface of the heat exchanger tubes, and since the cooling water temperature is relatively low, the formation of scale or slime is accelerated.

Thus, in order to avoid these problems, it is necessary to periodically clean the inside of the heat exchanger tubes on the one hand, and to control the pressure of the condenser in a predetermined range during operation on the other hand.

To this end, heretofore, the cleaning of the heat exchanger tubes is effected by travelling a brush inside each tube while changing the direction of the flow of the cooling water in the heat exchanger tubes by means of a change-over valve.

Also, the condenser pressure is controlled by controlling the temperature or volume of the cooling water to be supplied to the heat exchanger tubes by controlling a throttle of a two-way valve in a cooling water supply pipe, by controlling a throttle of a three-way valve for controlling a volume of the cooling water bypassing a cooling tower or radiator and returning to the heat exchanger tubes, or by controlling a pump motor speed of a cooling water supply pump by means of an inverter.

However, all of these prior art arrangements require use of a two-way valve, a three-way valve or a pump speed control means in addition to the change-over valve and, therefore, the cost of the arrangement becomes relatively expensive. Also, when cleaning the heat exchanger tubes by means of a brushes, the volume of cooling water must be increased. Thus, such two-way valve or three-way valves must be manually or automatically opened, which is either a troublesome operation or requires the installation of an expensive control means.

SUMMARY OF THE INVENTION

In view of the above-described problems, it is an object of the present invention to provide a condenser for a refrigerator which enables satisfactory washing of the inside of the heat exchanger tubes and yet allows the flow rate of cooling water to be controlled easily without providing an expensive equipment.

Another object of the present invention is to provide a method of operating a condenser for a refrigerator which enables satisfactory washing of the inside of the heat exchanger tubes and yet allows the flow rate of cooling water to be controlled easily without providing an expensive equipment.

To attain the above-described first object, the present invention provides a condenser for a refrigerator, having heat exchanger tubes for cooling said condenser which each has brush receivers and cooling water inlet/outlet ports at both ends thereof, one of the brush receivers accommodating a brush for washing said tube, cooling water supply and discharge pipes which are connected to the cooling water inlet/outlet ports, respectively, through a four-way valve, and a motor for driving said four-way valve, wherein, said four-way valve is operable to control the valve opening of the four-way valve for controlling the flow rate of cooling water supplied to the heat exchanger tubes, and is switchable to change the direction of flow in the heat exchanger tubes.

Preferably, in the above-described condenser, the four-way valve is operated through 90° by said driving motor to switch over flow paths within the four-way valve to thereby change the direction of flow in the heat exchanger tube, and wherein the flow rate of the cooling water is controlled by varying the valve opening in the range of from a 0° or 90° position, at which the flow paths are completely switched over from one to the other, to a 45° position, which is a middle opening position, at which the bypassing of the heat exchanger tubes is maximum.

To attain the above-described second object, the present invention provides a method of operating a condenser for a refrigerator, having heat exchanger tubes for cooling said condenser which each has brush receivers and cooling water inlet/outlet ports at both ends thereof, one of the brush receivers accommodating a brush for washing said tube, and cooling water supply and discharge pipes which are connected to the cooling water inlet/outlet ports, respectively, through a four-way valve, wherein, when the condenser is to be cooled, the valve opening of the four-way valve is controlled on the basis of the pressure in the condenser to thereby control the flow rate of cooling water supplied to the heat exchanger tubes, whereas, when the heat exchanger tubes are to be washed, the four-way valve is switched so as to change the direction of flow in the heat exchanger tubes, thereby allowing the washing brushes to travel through the tubes automatically, and thus automatically washing the inside of the tubes.

Preferably, in the above-described condenser operating method, the four-way valve is operated through 90° by a driving motor to switch over flow paths, and wherein the pressure in the condenser is controlled by varying the valve opening in the range of from a 0° or 90° position, at which the flow paths are completely switched over from one to the other, to a 45° position, which is a middle opening position, such that, when the pressure in the condenser is high, the valve is shifted toward the 0° or 90° position to increase the flow rate of cooling water supplied to the heat exchanger tubes, whereas, when the pressure in the condenser is low, the valve is shifted toward the 45° position to reduce the flow rate of cooling water supplied to the heat exchanger tubes.

In the present invention, a four-way valve is connected to the cooling water inlet/outlet ports of the heat exchanger tubes in the condenser of the refrigerator, and a brush is inserted into each heat exchanger tube. When the washing of the tube is to be executed, the valve is operated so as to switch over the flow paths from one to the other completely. Thus, by switching the four-way valve, the direction of flow in the tubes is changed to allow the brushes to travel so as to wash the inside of the tubes automatically. When washing of the tubes is not performed, the valve opening inside the four-way valve is controlled so as to control the flow rate of cooling water supplied to the condenser, thereby controlling the pressure in the condenser.

According to the present invention, since the heat exchanger tubes are supplied with cooling water through the four-way valve, and the flow paths can be readily switched over from one to the other, the inside of the heat exchanger tubes can be washed satisfactorily.

In addition, since the four-way valve can be controlled in different valve opening positions, the flow rate of cooling water can be controlled in accordance with a change in the pressure inside the condenser. And there is no need to provide an expensive control valve or control means in addition to the four-way valve to control the flow rate of the cooling water.

The above and other objects, features and advantages of the present invention will become more apparent from the following description when taken in conjunction with the accompanying drawings in which a preferred embodiment of the present invention is shown by way of illustrative examples.

PREFERRED EMBODIMENT OF THE INVENTION

The present invention will be described below more specifically with reference to the accompanying drawings and by way of one embodiment. However, it should be noted that the present invention is not limited to the embodiment.

Figure 1:
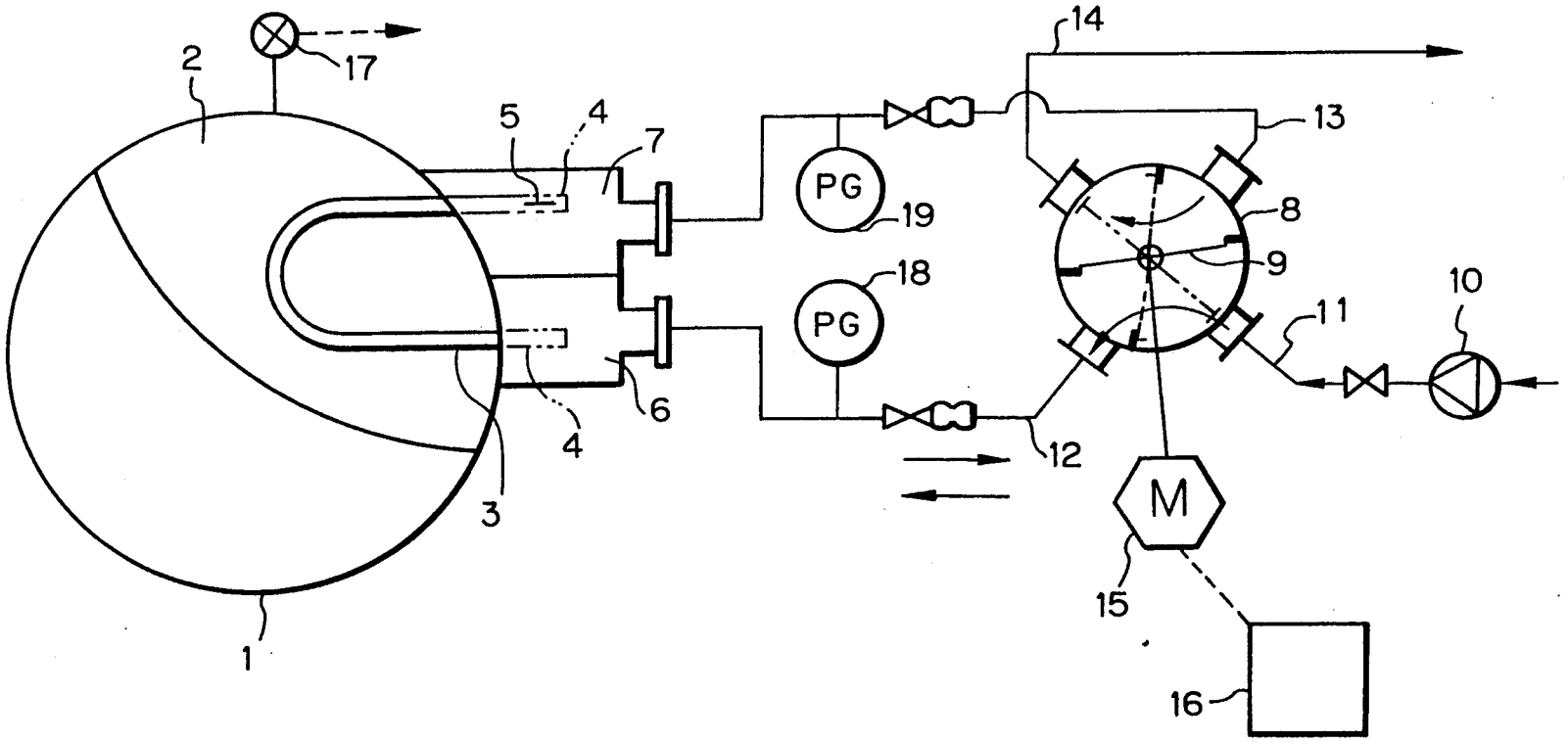
FIG. 1 is a flow sheet showing the arrangement of a condenser for a refrigerator according to the present invention.

FIG. 1 is a flow sheet showing the arrangement of the condenser for a refrigerator according to the present invention.

In FIG. 1, reference numeral 1 denotes a refrigerator, 2 a condenser, 3 a heat exchanger tube, 4 brush receivers, 5 a brush for washing the tube (actually, a plurality of tubes each having a brush are provided, but only one is shown for simplification), 6 and 7 cooling water inlet/outlet ports, 8 a four-way valve, 9 a movable valve element, 10 a cooling water pump, 11 to 14 cooling water flow paths, 15 a valve driving motor, 16 a digital pressure indicating controller, 17 a pressure transmitter, and 18 and 19 pressure gauges.

Next, the arrangement of the refrigerator condenser will be explained. The heat exchanger tubes 3 are installed in the condenser 2, and the brush receivers 4 are provided at both ends, respectively, of each tube 3. The washing brush 5 is accommodated in one of the brush receivers 4 in each tube 3. The cooling water inlet/outlet ports 6 and 7 are provided at both ends, respectively, of the tubes 3 so that cooling water flows through the heat exchanger tubes 3 via the brush receivers 4. The cooling water inlet/outlet ports 6 and 7 are connected to the four-way valve 8 through the pipes 12 and 13. The four-way valve 8 is connected to both the cooling water supply pipe 11 and the cooling water discharge pipe 14.

Figure 2:
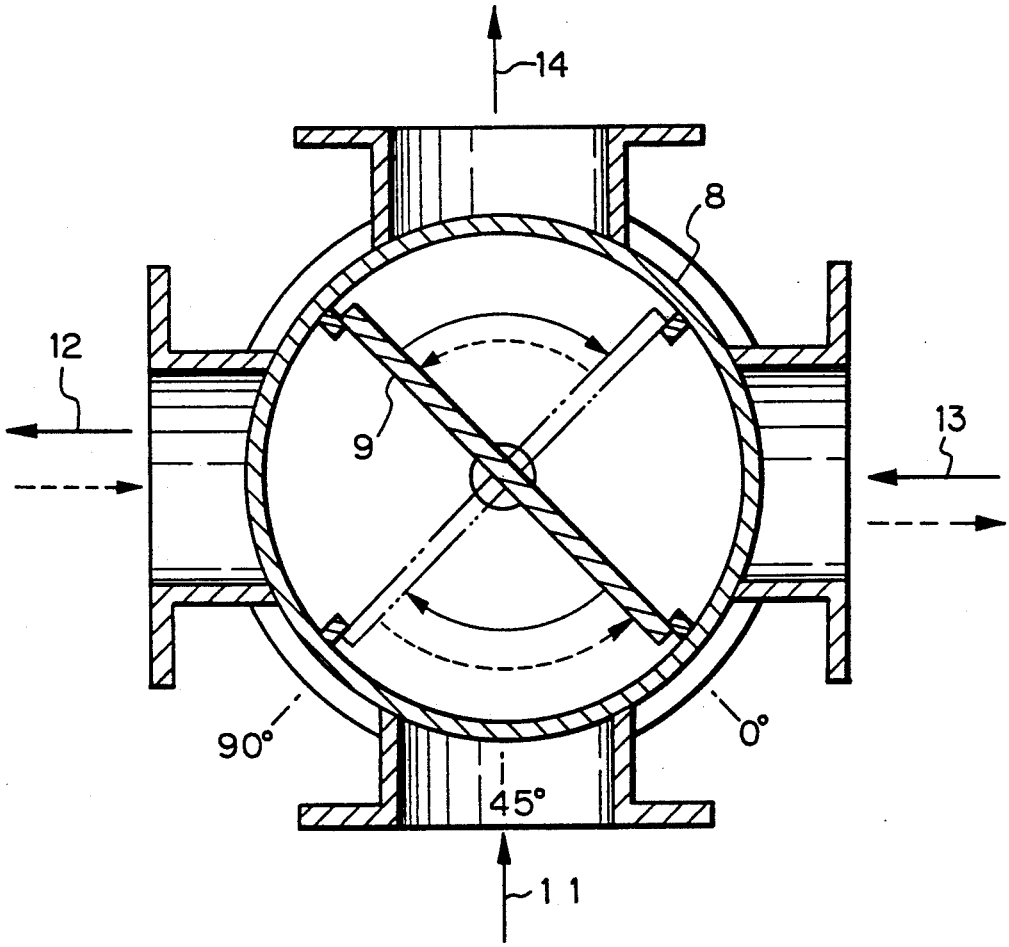
FIG. 2 is an enlarged sectional view of a four-way valve used in the arrangement.

FIG. 2 is an enlarged sectional view of the four-way valve 8. The four-way valve 8 is capable of switching flow paths by means of the movable valve element 9, which is connected to the driving motor 15.

The method of operating the condenser will next be explained. In an operation in which cooling water is passed through the heat exchanger tubes 3, cooling water enters the four-way valve 8 from the pipe 11 and passes through the pipe 12 to enter the heat exchanger tubes 3 through the cooling water inlet port 6. Cooling water flowing out of the heat exchanger tubes 3 enters the pipe 13 through the cooling water outlet port 7 and passes through the four-way valve 8 so as to be discharged toward a cooling tower (not shown) through the pipe 14.

In this condenser, the driving motor 15 is providd with a potentiometer for the valve opening range of from 0° and 90° to 45°, which is a middle opening position with respect to a valve opening of 90°, through which the four-way valve 8 is operated so as to switch over the paths from one to the other, thereby varying the flow rate of cooling water short-passing through the four-way valve 8 on the basis of the degree of valve opening, and thus enabling the flow rate of cooling water supplied to the condenser to be controlled by the digital pressure indicating controller 16. The control of the flow rate of cooling water supplied is effected by a pressure or temperature controller which is supplied with the condenser pressure from the pressure transmitter 17 or the cooling water discharge temperature as an input signal (in the embodiment shown, the condenser pressure is supplied as an input signal). As the flow rate of cooling water supplied increases (e.g., the valve shifts toward the 0° position), the rate of heat transfer in the condenser increases, so that the condenser pressure and temperature can be lowered. As the flow rate of cooling water supplied decreases (i.e., the valve shifts toward the 45° position), the rate of heat transfer descrases, so that the condenser pressure and temperature can be raised.

To wash the heat exchanger tubes 3, the movable valve element 9 of the four-way valve 8 is operated, i.e., shifted from 0° position to 90° position and vice versa, to switch over the flow paths so that cooling water passes through the pipe 11—the four-way valve 8—the pipe 13—the port 7—the tube 3—the port 6—the pipe 12—the four-way valve 8—the pipe 14, and then cooling water passes reversely through the pipe 11—the four-way valve 8—the pipe 12—the port 6—the tube 3—the port 7—the pipe 13—the four-way valve 8—and the pipe 14, thereby allowing the washing brush 5 to travel automatically through the each heat exchanger tube 3, and thus washing the inside of the tubes 3. In this washing process, the flow paths are switched over periodically (e.g., every 8 hours) so as to change the direction of flow in the tubes 3, thereby allowing the brush 5 to travel automatically through each tube 3, and thus effecting automatic washing.

According to the present invention, the pressure in a condenser for a refrigerator is controlled by using a four-way valve which also switches over the direction of the flow of the cooling water in the heat exchanger tubes. Accordingly, the following advantageous effects are produced:

(1) It is unnecessary to use a device such as a two-way valve or a three-way valve for the temperature control of cooling water. Therefore, both the condenser and the operating method of the present invention are economical.

(2) It is possible to maintain the flow velocity of cooling water necessary for moving the brush to wash the heat exchanger tubes and, at the same time, to control the flow rate of cooling water supplied to the refrigerator. Accordingly, it is possible to operate the refrigerator safely throughout the year.

What is claimed is:

1. A condenser for a refrigerator, having heat exchanger tubes for cooling said condenser each of which has brush receivers and cooling water inlet/outlet ports at both ends thereof, one of said brush receivers accommodating a brush for washing said tube, cooling water supply and discharge pipes which are connected to said cooling water inlet/outlet ports, respectively, through a four-way valve, and a motor for driving said four-way valve through a plurality of positions, wherein the position of said four-way valve is switchable to control the valve opening of said four-way valve for controlling the flow rate of cooling water supplied to said heat exchanger tubes, and to change the direction of flow in said heat exchanger tubes.

2. A condenser according to claim 1, wherein said four-way valve is rotated through 90° by said driving motor to switch over flow paths within said four-way valve to thereby change said direction of flow in said heat exchanger tubes, and wherein the flow rate of cooling water is controlled by varying the valve opening from a 0° or 90° position, at which the flow paths are completely switched over from one to the other, to a 45° position, which is a middle opening position, at which the bypassing of the heat exchanger tubes is maximum.

3. A condenser according to claim 1, wherein said valve opening of said four-way valve is controlled on the basis of the pressure in said condenser.

4. A condenser according to claim 1, wherein said valve opening of said four-way valve is controlled on the basis of the temperature of the cooling water in said discharge pipe.

5. A method of operating a condenser for a refrigerator, having heat exchanger tubes for cooling said condenser each of which has brush receivers and cooling water inlet/outlet ports at both ends thereof, one of said brush receivers accommodating a brush for washing said tube, and cooling water supply and discharge pipes which are connected to said cooling water inlet/outlet ports, respectively, through a four-way valve, wherein, when said condenser is to be cooled, the valve opening of said four-way valve is controlled on the basis of the pressure in said condenser to thereby control the flow rate of cooling water supplied to said heat exchanger tubes, whereas, when said heat exchanger tubes are to be washed, said four-way valve is switched so as to change the direction of flow in said heat exchanger tubes, thereby allowing said washing brushes to travel through said tubes automatically, and thus automatically washing the inside of said tubes.

6. A condenser operating method according to claim 5, wherein said four-way valve is rotated through 90° by a driving motor to switch over flow paths, and wherein the pressure in said condenser is controlled by varying the valve opening from a 0° or 90° position, at which the flow paths are completely switched over from one to the other, to a 45° position, which is a middle opening position, such that, when the pressure in said condenser is high, said valve is shifted toward said 0° or 90° position to increase the flow rate of cooling water supplied to said heat exchanger tubes, whereas, when the pressure in said condenser is low, said valve is shifted toward said 45° position to reduce the flow rate of cooling water supplied to said heat exchanger tubes.

7. A condenser operating method according to claim 5, wherein said valve opening of said four-way valve is controlled on the basis of the temperature of the cooling water in said discharge pipe.

* * * * *